US010814664B2

(12) United States Patent
Kuriyama

(10) Patent No.: US 10,814,664 B2
(45) Date of Patent: Oct. 27, 2020

(54) FILE

(71) Applicant: KING JIM CO., LTD., Tokyo (JP)

(72) Inventor: Tomoyuki Kuriyama, Tokyo (JP)

(73) Assignee: KING JIM CO., LTD., Tokyo (JP)

( * ) Notice: Subject to any disclaimer, the term of this patent is extended or adjusted under 35 U.S.C. 154(b) by 0 days.

(21) Appl. No.: 16/325,167

(22) PCT Filed: Apr. 17, 2018

(86) PCT No.: PCT/JP2018/015846
§ 371 (c)(1),
(2) Date: Feb. 12, 2019

(87) PCT Pub. No.: WO2018/194054
PCT Pub. Date: Oct. 25, 2018

(65) Prior Publication Data

US 2019/0184733 A1 Jun. 20, 2019

(30) Foreign Application Priority Data

Apr. 18, 2017 (JP) ..... 2017-081971

(51) Int. Cl.
*B42F 7/00* (2006.01)
*B42F 7/02* (2006.01)

(52) U.S. Cl.
CPC ..... *B42F 7/02* (2013.01); *B42P 2241/04* (2013.01)

(58) Field of Classification Search
CPC ..... B42F 7/02; B42F 2241/04
(Continued)

(56) References Cited

U.S. PATENT DOCUMENTS 6,382,864 B1 * 5/2002 Moor ..... B42F 7/02 206/37
6,666,610 B1 * 12/2003 Moor ..... A45C 7/0068 229/67.1

(Continued)

FOREIGN PATENT DOCUMENTS

EP 3 115 224 A1 1/2017
JP S50132110 U 10/1975

(Continued)

OTHER PUBLICATIONS

International Search Report and Written Opinion issued for Application No. PCT/JP2018/015846 dated Jun. 12, 2018.

(Continued)

*Primary Examiner* — Peter N Helvey
(74) *Attorney, Agent, or Firm* — Troutman Pepper Hamilton Sanders LLP

(57) ABSTRACT

A file includes a cover body and a pocket body attached to the cover body. The cover body includes a front cover section, a spine section, and a back cover section. The front cover section and the back cover section are rotatable relative to each other about the spine section via a hinge part so as to face each other. The pocket body includes a storage part arranged to extend from the front cover section to the back cover section and allowing storage of an item to be stored. A held part is provided on an external side of the storage part in a plan view. The front cover section further includes a holding member for holding the held part movably. The pocket body is bendable together with the cover body while the stored item is in the pocket body.

6 Claims, 10 Drawing Sheets

(58) Field of Classification Search
USPC ..... 229/67.1
See application file for complete search history.

(56) References Cited

U.S. PATENT DOCUMENTS

| | | | | |
|---|---|---|---|---|
| 7,237,805 | B2 * | 7/2007 | Fasan | B42F 11/00 281/21.1 |
| 7,789,430 | B2 * | 9/2010 | Wittmeyer, Jr. | B43K 23/002 248/441.1 |
| 8,176,822 | B1 * | 5/2012 | Halfen | B26F 1/36 30/363 |
| D750,169 | S * | 2/2016 | Russell | D19/26 |
| 9,290,034 | B2 * | 3/2016 | Busam | B42F 11/00 |
| 9,346,311 | B2 * | 5/2016 | Leonard | B42F 7/06 |
| 2006/0278686 | A1 | 12/2006 | Rittmann | |
| 2016/0243878 | A1 | 8/2016 | Loree et al. | |

FOREIGN PATENT DOCUMENTS

| | | | |
|---|---|---|---|
| JP | S5757978 | U | 4/1982 |
| JP | S5919377 | U | 2/1984 |
| JP | H02144479 | U | 12/1990 |
| JP | H05177970 | A | 7/1993 |
| JP | H0948193 | A | 2/1997 |
| JP | 2004216595 | A | 8/2004 |
| JP | 2010274609 | A | 12/2010 |
| JP | 2015229309 | A | 12/2015 |
| WO | 2012/161357 | A1 | 11/2012 |

OTHER PUBLICATIONS

Office Action and Search Report issued in corresponding Chinese Patent Application No. 201880004199.1 dated Jul. 14, 2020 (submitted in Chinese only).

* cited by examiner

FILE

CROSS-REFERENCE TO RELATED APPLICATIONS

This Application is a National Stage of International Application PCT/JP2018/015846 filed Apr. 17, 2018, which claims priority to Japanese Application No. 2017-081971 filed Apr. 18, 2017. The above applications are incorporated herein by reference in their entirety.

TECHNICAL FIELD

The present invention relates to a file with a pocket body for storing an item to be stored such as a document attached to a cover body.

BACKGROUND

As described in Japanese Laid-open Patent Publication No. 5-177970 or Japanese Laid-open Patent Publication No. 2004-216595, for example, according to a conventionally known configuration of a file of the foregoing type, a pocket made of a synthetic resin thin sheet is joined by thermal welding or ultrasonic welding to a synthetic resin cover body.

The pocket of such a file is formed like a bag having a rectangular shape with one lateral edge portion forming an opening part without being joined to the cover body, and the other lateral edges joined to the cover body.

According to the inventions described in the above references, a substantially central part of one bag body in a horizontal direction is welded to the cover body along the substantially entire length of the bag body in a vertical direction to form two pocket parts adjacent to each other across the welded part.

In addition, the width of one of the pocket parts (a distance between the welded part and a lateral edge at a position facing the welded part) is determined to be slightly larger than the width of an item assumed to be stored. Further, while the cover body is folded, specifically, while the file is closed, the width of the cover body is determined to be slightly larger than the width of the one pocket part.

Here, one purpose of using the file is to protect an item to be stored from external force with the cover body. In consideration of the performance of such protection, the width of the cover body is preferably larger than the width of the one pocket part or that of an item to be stored in the configurations of the above noted prior art. However, the file with this configuration is to have an area larger than the area of an item to be stored even while the file is closed.

Additionally, if a user is to carry the file stored in a bag, for example, the bag is required to have a size allowing storage of the file. This means that such a file does not have high convenience due to the size of the file.

Regarding the configurations of the above noted prior art, if the file with a stored item in the pocket part is unintentionally carried so as to point the opening part downward, the stored item naturally drops down from the opening part of the pocket part. Hence, a user is required to pay attention to the direction of the file being carried.

Thus, a file having favorable convenience is desired from viewpoints of a size and a state of use.

The present invention has been made in view of the foregoing issues, and is intended to provide a file having favorable convenience.

SUMMARY

The present invention is intended for a file including a cover body and a pocket body attached to the cover body. The cover body includes a first cover section and a second cover section, and the first cover section and the second cover section are rotatable relative to each other so as to face each other. The pocket body includes a storage part arranged to extend from the first cover section to the second cover section and allowing storage of an item to be stored, an opening part for putting the item to be stored into the storage part and taking out the stored item from the storage part, and a held part located external to the storage part in a plan view. The cover body includes a holding member provided to at least one of the first cover section and the second cover section and holding the held part movably.

The holding member is provided to one of the first cover section and the second cover section.

The pocket body includes a fixed part fixed to the other cover section.

The holding member is provided to each of the first cover section and the second cover section.

The held part includes an insertion hole. The holding member includes an inserted part inserted in the insertion hole. As long as the length of the insertion hole in one direction is greater than the length of the inserted part in the one direction, the length of the insertion hole in a different direction perpendicular to the one direction may be substantially equal to the length of the inserted part in the different direction.

The cover body includes a spine section provided between the first cover section and the second cover section to be continuous with the first cover section and the second cover section via a hinge part.

The cover body includes a spine section located between the first cover section and the second cover section. The spine section includes a hinge part. The first cover section and the second cover section are rotatable relative to each other about the spine section via the hinge part.

The first cover section and the second cover section are rotatable relative to each other from an end portion of the first cover section on one side and from an end portion of the second cover section on an opposite side in the width direction of the cover body so as to make an end portion of the first cover section on the opposite side and an end portion of the second cover section on the one side get closer to or away from each other.

According to the present invention, the storage part of the pocket body is arranged to extend from the first cover section to the second cover section. Thus, the cover body can be bent so as to make the first cover section and the second cover section face each other while the stored item is in the pocket body. As a result, convenience can be increased.

Specifically, the cover body is bent so as to make the first cover section and the second cover section face each other. By doing so, the pocket body is bent to be housed between the first cover section and the second cover section. This allows size reduction of the stored item. As a result, a file having a smaller area than the area of the item to be stored can be provided.

Additionally, the stored item is in the pocket body in a state of being bent to conform to the bending of the pocket body. In this state, the stored item and the pocket body keep contacting each other at their bent positions or at peripheries of the bent positions. This increases the force of friction between the stored item and the pocket body. Thus, the stored item is unlikely to drop down from the opening part, so that the stored item can be housed reliably in the file.

DETAILED DESCRIPTION

Figure 1:
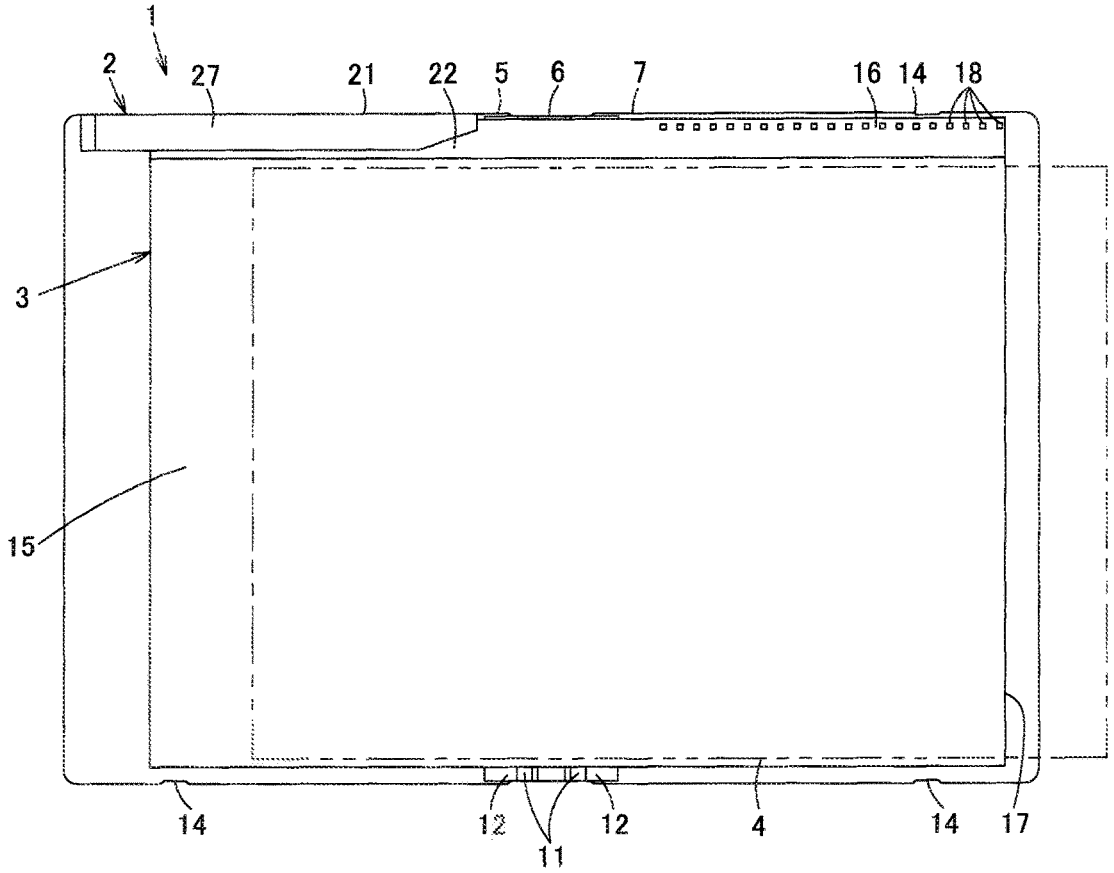
FIG. 1 is a reference front view showing a file in a state of being used according to a first embodiment of the present invention.
Figure 2:
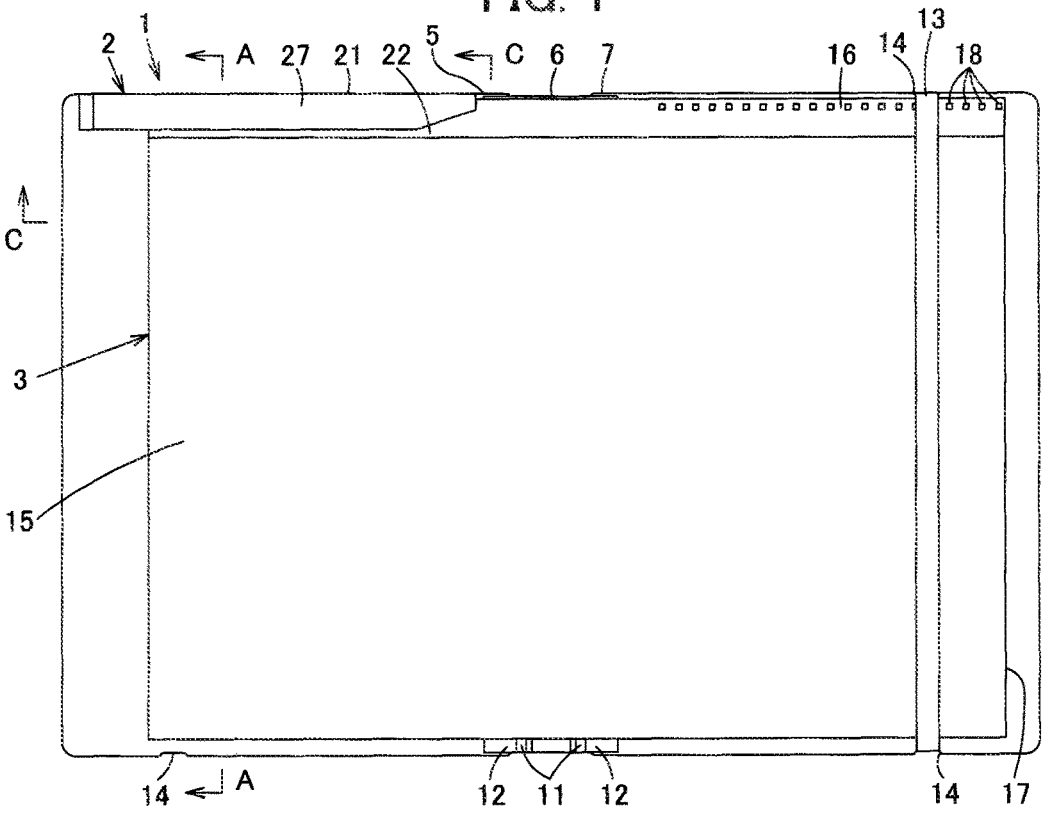
FIG. 2 is a front view showing a state in which a cover body of the file is opened.
Figure 3:
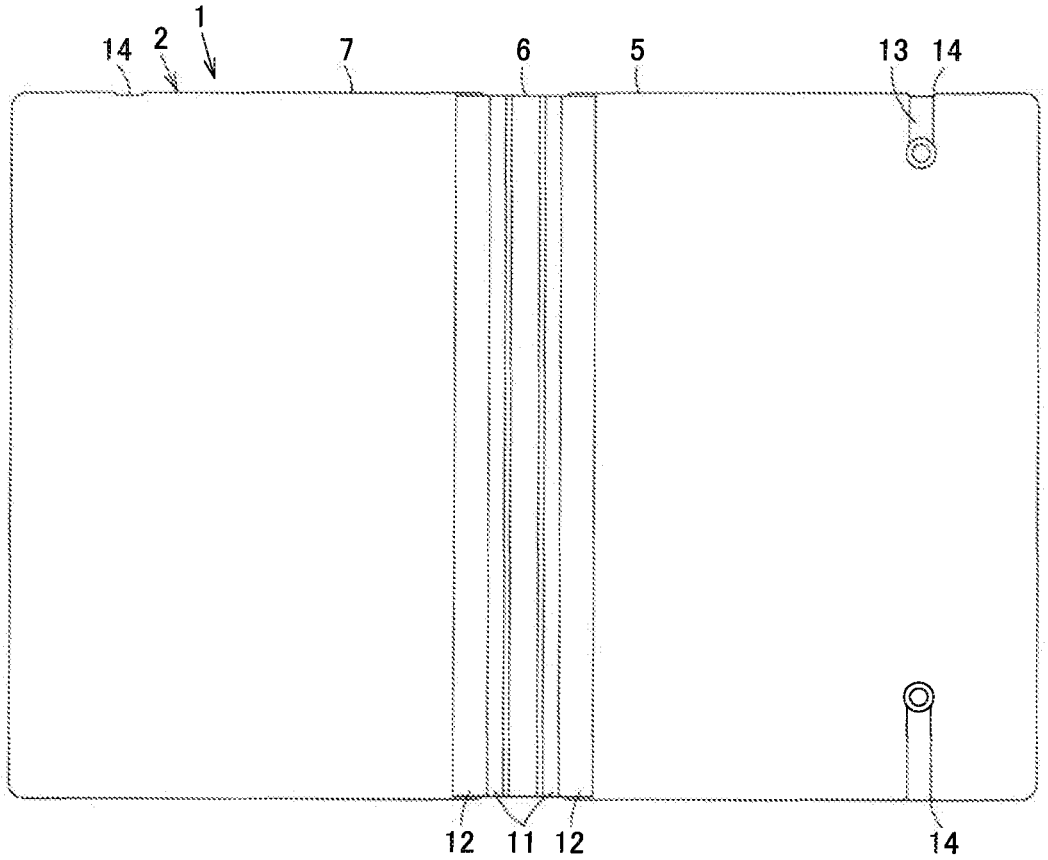
FIG. 3 is a back view showing a state in which the cover body of the file is opened.
Figure 4:
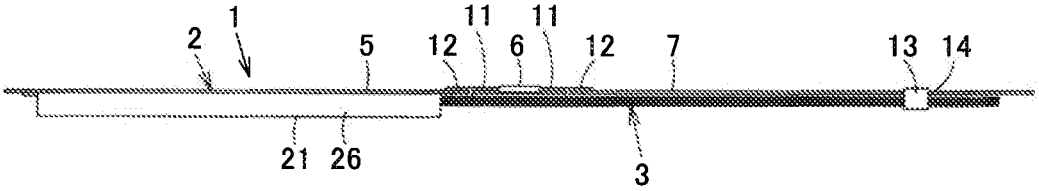
FIG. 4 is a plan view showing a state in which the cover body of the file is opened.
Figure 5:
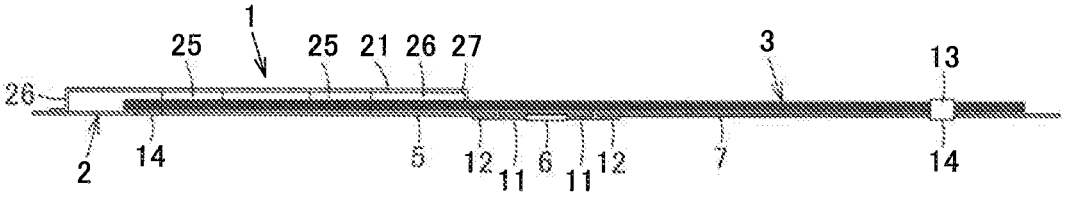
FIG. 5 is a bottom view showing a state in which the cover body of the file is opened.
Figure 6:
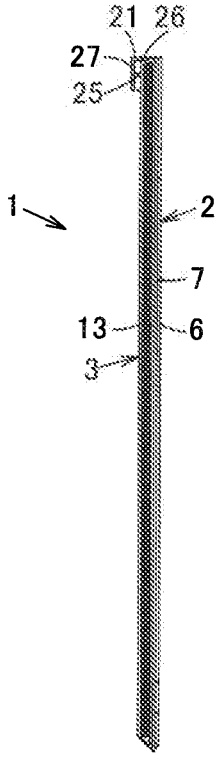
FIG. 6 is a right side view showing a state in which the cover body of the file is opened.
Figure 7:
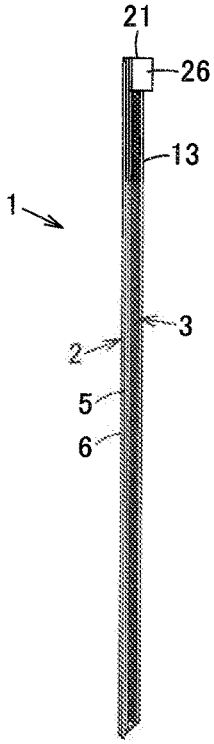
FIG. 7 is a left side view showing a state in which the cover body of the file is opened.
Figure 8:
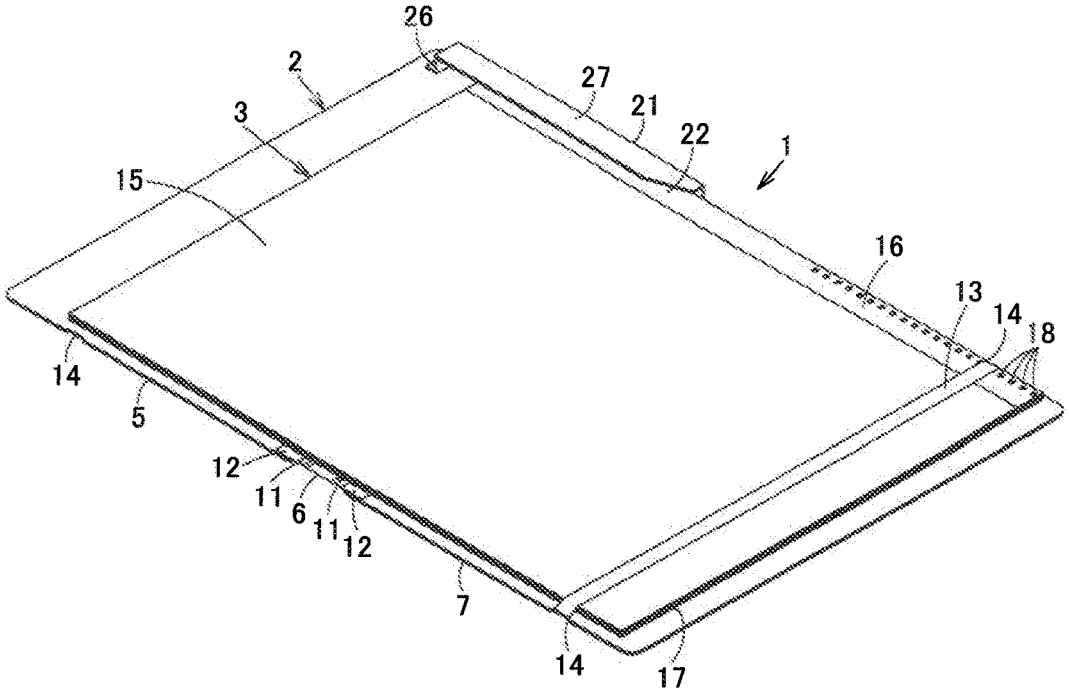
FIG. 8 is a perspective view showing a state in which the cover body of the file is opened.
Figure 9:
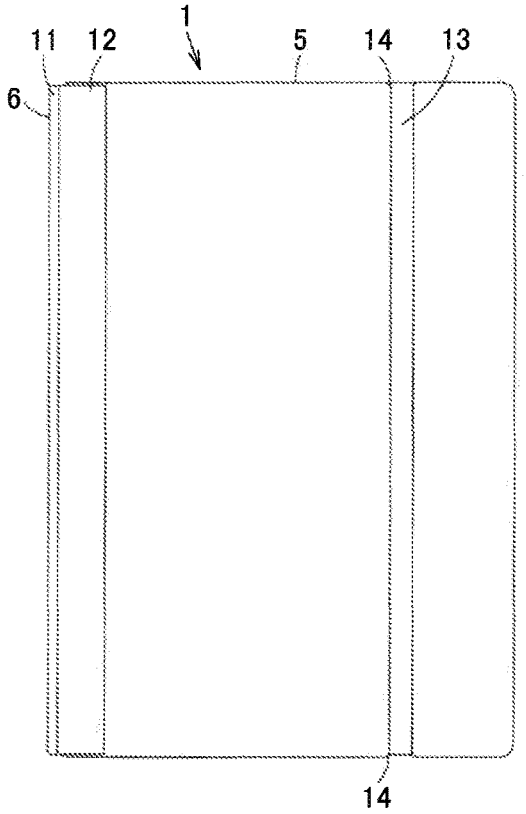
FIG. 9 is a front view showing a state in which the cover body of the file is closed.
Figure 10:
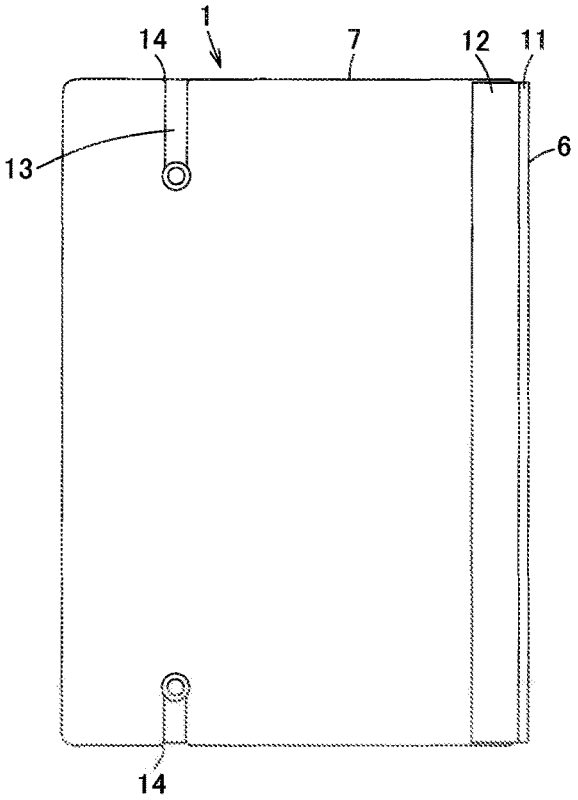
FIG. 10 is a back view showing a state in which the cover body of the file is closed.
Figure 11:
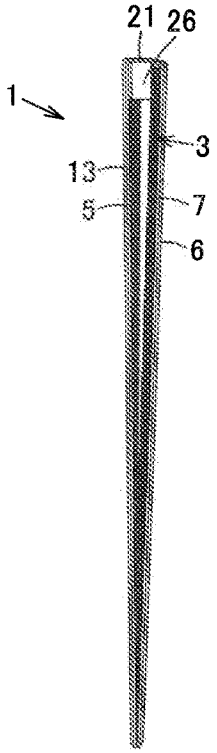
FIG. 11 is a right side view showing a state in which the cover body of the file is closed.
Figure 12:
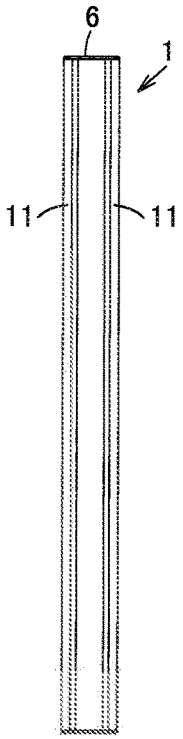
FIG. 12 is a left side view showing a state in which the cover body of the file is closed.
Figure 13:
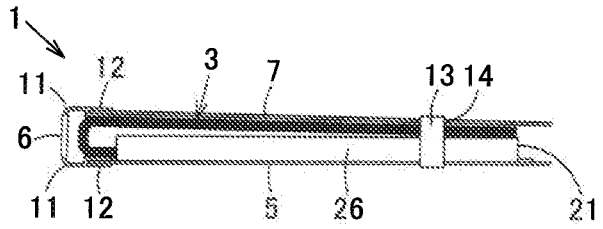
FIG. 13 is a plan view showing a state in which the cover body of the file is closed.
Figure 14:
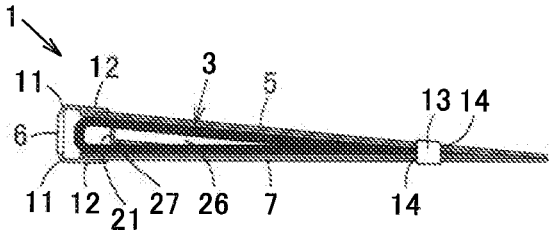
FIG. 14 is a bottom view showing a state in which the cover body of the file is closed.
Figure 15:
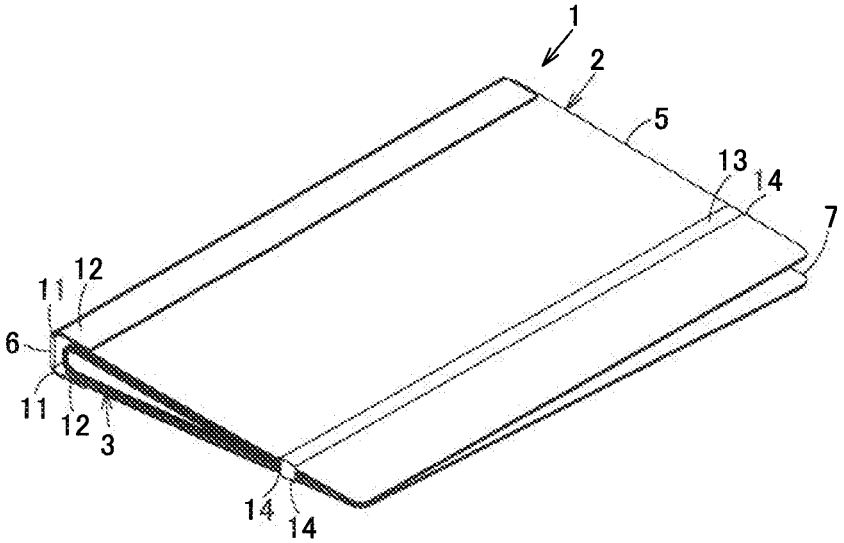
FIG. 15 is a perspective view showing a state in which the cover body of the file is closed.
Figure 16:
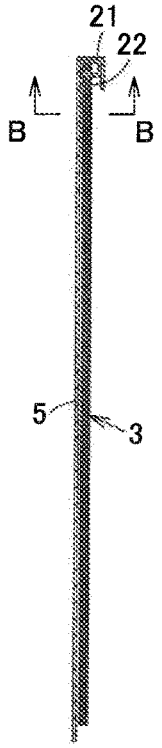
FIG. 16 is an end view cut along A-A in FIG. 2.
Figure 17:
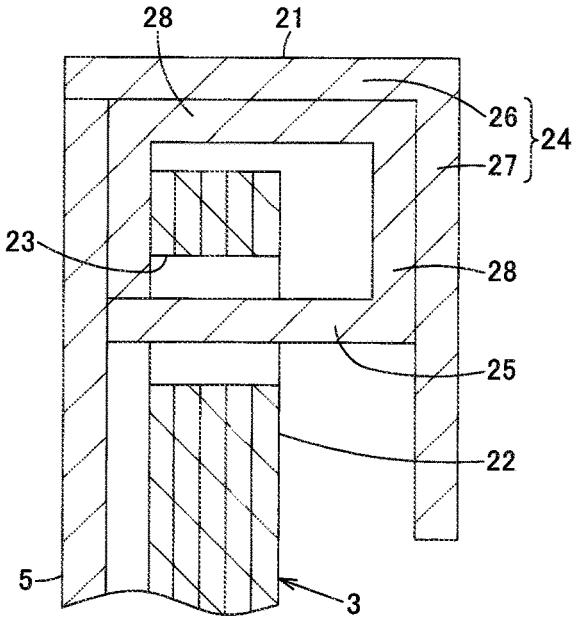
FIG. 17 is a partially enlarged view taken along B-B in FIG. 16.

A configuration of a first embodiment of the present invention will be described below in detail by referring to the drawings. In the following description, a vertical direction in FIG. 1 corresponds to a "vertical direction of a file." Likewise, a horizontal direction in FIG. 1 corresponds to a "horizontal direction of the file," and a length in the horizontal direction corresponds to a "width."

In FIGS. 1 to 15, 1 is a file. The file 1 includes a pocket body 3 welded and attached by a method such as thermal welding or ultrasonic welding to an inner side surface as one surface of a cover body 2. An item 4 to be stored such as a document can be stored in the pocket body 3. It is noted that FIG. 1 shows a state in which the item 4 to be stored indicated by alternate long and two short dashed lines is being stored into the pocket body 3.

The cover body 2 includes a front cover section 5 as a first cover section, a spine section 6, and a back cover section 7 as a second cover section arranged in succession in the horizontal direction. All of the front cover section 5, the spine section 6, and the back cover section 7 are made of synthetic resin or paper, for example. For example, in one configuration, all of the front cover section 5, the spine section 6, and the back cover section 7 may be made of the same material. Further, in one configuration, all of the front cover section 5, the spine section 6, and the back cover section 7 may be made of different materials. Still further, in one configuration, the front cover section 5 and the back cover section 7 may be made of a material different from a material for the spine section 6. In this way, the respective materials are appropriately selectable.

The front cover section 5 and the back cover section 7 are substantially rectangular. The spine section 6 is joined to an end portion (right end portion) along its entire length in the vertical direction on one side of the front cover section 5 in the horizontal direction, and to an end portion (left end portion) along its entire length in the vertical direction on the opposite side of the back cover section 7 in the horizontal direction.

The spine section 6 includes two hinge parts 11 separated by a predetermined width in the horizontal direction and arranged to extend in the vertical direction, and connection parts 12 provided external to the hinge parts 11 in the horizontal direction.

In addition, the connection parts 12 are welded and connected to the front cover section 5 and the back cover section 7, thereby allowing the front cover section 5 and the back cover section 7 to rotate relative to each other about the spine section 6 via the hinge parts 11 in such a manner that an end portion (left end portion) on one side of the front cover section 5 in the horizontal direction and an end portion (right end portion) on the opposite of the back cover section 7 in the horizontal direction get closer to or away from each other. Specifically, rotating at least one of the front cover section 5 and the back cover section 7 allows opening and closing of the cover body 2 in the horizontal direction. By doing so, the cover body 2 can be placed in a state shown in FIGS. 1 to 8 (opened state) in which the front cover section 5, the spine section 6, and the back cover section 7 are arranged on the substantially same plane, and in a state shown in FIGS. 9 to 15 (closed state) in which the front cover section 5 and the back cover section 7 are arranged to face each other by making the left end portion of the front cover section 5 and the right end portion of the back cover section 7 approach each other, and the front cover section 5 and the back cover section 7 are bent from the spine section 6. The opened state is not limited to the state in which the front cover section 5, the spine section 6, and the back cover section 7 are arranged on the substantially same plane but may be any state in which the left end portion of the front cover section 5 and the right end portion of the back cover section 7 are separated in comparison to the closed state.

Additionally, the back cover section 7 is provided with string-shaped rubber 13 formed into a ring-like shape as a retention member for retaining the cover body 2 in the closed state.

Further, a lower end portion of the front cover section 5 and opposite end portions of the back cover section 7 in the vertical direction are each provided with a recess 14 at which the rubber 13 can be engaged.

In addition, with the cover body 2 in the closed state, the rubber 13 is extended from the back cover section 7 to the front cover section 5 while being stretched to be engaged with each recess 14. By doing so, the rubber 13 is held in the state of being arranged on an outer side surface of the front cover section 5 and an outer side surface of the back cover section 7 as opposite surfaces thereof. The rubber 13 exerts contractile force to retain the cover body 2 in the closed state.

Further, a synthetic resin holding member 21 for movably holding the pocket body 3 is provided on the left side of the upper end portion of the front cover section 5.

The pocket body 3 is formed using synthetic resin, for example, into a shape like a rectangular sheet. While multiple pocket bodies 3 are stacked in a thickness direction, the pocket bodies 3 are arranged to extend from the front cover section 5 to the back cover section 7 across the spine section 6.

The pocket body 3 includes a bag-like storage part 15 allowing storage of the item 4 to be stored, and a fixed part 16 extending lengthwise in the horizontal direction and provided on an upper side as an external side of the storage part 15 in the vertical direction to be integral with the storage part 15.

The storage part 15 has a shape like a bag having a right end portion provided with an opening part 17 extending along the entire length thereof in the vertical direction, closed opposite end portions in the vertical direction, and a closed left end portion.

More specifically, while a single synthetic resin rectangular sheet for the pocket body 3 is folded into halves, for example, upper end portions on the opposite side to the folded position (lower end portion) in the vertical direction are welded to each other. Left end portions are further welded to each other, thereby forming the storage part 15 having a rectangular bag-like shape in a plan view with the closed welded end portions, and with the unclosed right end portion where the opening part 17 is arranged.

It is noted that as long as the storage part 15 is formed into a bag-like shape closed at two or more end portions, the pocket body 3 is not limited to the configuration where the opening part 17 is provided at the right end portion. The pocket body 3 may also be configured in such a manner that the opening part 17 is provided at the upper end portion, left end portion, or lower end portion of the storage part 15 near the fixed part 16.

Also, the two stacked sheets are welded to each other so as to form an elongated shape in the horizontal direction above the upper end portion of the storage part 15 corresponding to one side thereof along the entire length of the storage part 15 in the horizontal direction. By doing so, the fixed part 16 is formed. The fixed part 16 includes a held part 22 provided at a position corresponding to the holding member 21, and a welded part 18 described later.

Additionally, the fixed part 16 is welded intermittently to the back cover section 7 as a cover section without the holding member 21 so as to form a line in the horizontal direction. By doing so, the welded part 18 is fixed to the back cover section 7.

Here, as shown in FIGS. 16 to 19, the held part 22 includes multiple (two, for example) insertion holes 23 of the same linear shape extending along the same horizontal direction and being separated from each other.

Further, the holding member 21 includes a case unit 24 arranged so as to cover a part of the left end side of the upper end portion of the pocket body 3 in a plan view, and a plate-like inserted part 25 provided in the case unit 24 and inserted in the insertion hole 23.

The case unit 24 includes a first wall part 26 provided so as to stand upright substantially vertically from the upper end portion of the front cover section 5 in an inward direction determined when the file 1 is closed, and a second wall part 27 provided so as to extend substantially vertically to the first wall part 26 from an end portion (tip portion) of the first wall part 26 opposite an end portion (base portion) of the first wall part 26 contacting the front cover section 5 (substantially parallel to the front cover section 5). The case unit 24 is substantially L-shaped in a sectional view.

Additionally, a base part 28 is provided inside the case unit 24 to extend along the first wall part 26 and the second wall part 27. The inserted part 25 is provided to extend from a tip portion of the base part 28 substantially vertically toward the front cover section 5. Specifically, the inserted part 25 is connected to the base part 28 and the front cover section 5 substantially vertically.

The width dimension of the inserted part 25 is less than the width dimension of the insertion hole 23. For example, the length of the inserted part 25 is about half of the length of the insertion hole 23. More specifically, the length of the insertion hole 23 in one direction (horizontal direction) is greater than the length of the inserted part 25 in the one direction (horizontal direction). The length of the insertion hole 23 in a different direction (vertical direction) perpendicular to the one direction is slightly greater than the length of the inserted part 25 in the different direction (vertical direction). The inserted part 25 can slide in the insertion hole 23. Meanwhile, the length of the insertion hole 23 in the vertical direction may be substantially equal to the length of the inserted part 25 in the vertical direction, as long as such lengths allow the inserted part 25 to slide in the insertion hole 23.

Figure 18:
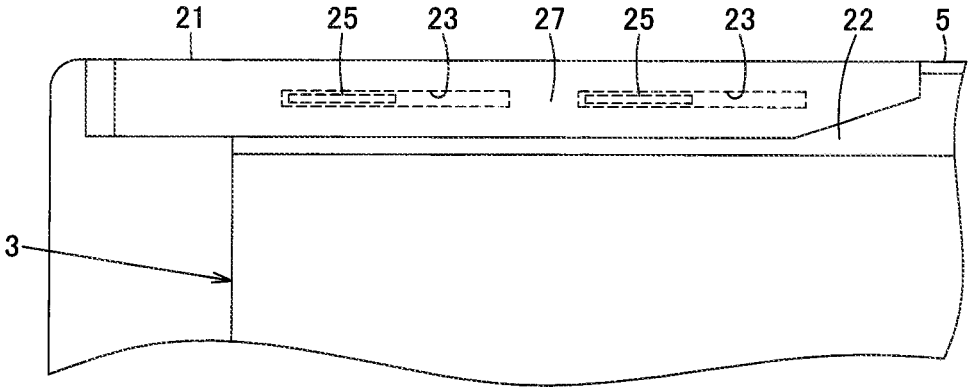
FIG. 18 is a partially enlarged view taken along C-C in FIG. 2.
Figure 19:
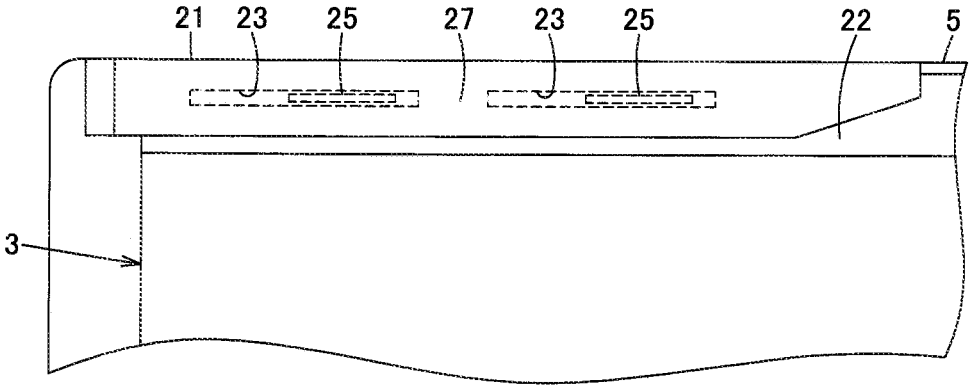
FIG. 19 is a partially enlarged view showing a state in which a pocket body has been moved from the state shown in FIG. 18 relative to the cover body.

In addition, the inserted part 25 is inserted in the insertion hole 23. Thus, if a left side portion of the pocket body 3 slides along the inserted part 25 relative to the front cover section 5 so as to guide the insertion hole 23 along the inserted part 25 while the inserted part 25 is arranged on the left side in the insertion hole 23 as shown in FIG. 18, for example, the inserted part 25 becomes arranged on the right side in the insertion hole 23 as shown in FIG. 19. Further, displacement of the pocket body 3 in the thickness direction is restricted by the case unit 24. Specifically, in the file 1, the inserted part 25 is inserted in the insertion hole 23 and a left side portion of the upper end portion of the pocket body 3 around the inserted part 25 and the insertion hole 23 is partially covered by the case unit 24. Asa result, the pocket body 3 is held so as to be movable in the horizontal direction relative to the front cover section 5.

The operation and effect of the foregoing first embodiment will be described next.

As shown in FIG. 1, for storing the item 4 to be stored in the file 1 and carrying the file 1, the front cover section 5, the spine section 6, and the back cover section 7 are first arranged on the substantially same plane to place the cover body 2 in the opened state. In this state, the item 4 to be stored is inserted into the storage part 15 through the opening part 17, thereby storing the item 4 to be stored in the storage part 15.

Next, while the cover body 2 is opened, the front cover section 5 and the back cover section 7 of the cover body 2 are rotated relative to each other about the spine section 6 via the hinge parts 11 so as to make the left end portion of the front cover section 5 and the right end portion of the back cover section 7 get closer to each other. By doing so, the cover body 2 is placed in the closed state with the front cover section 5 and the back cover section 7 facing each other.

Also, the fixed part 16 of the pocket body 3 is fixed to the back cover section 7. Thus, when the cover body 2 is closed, the pocket body 3 receives force acting toward the unfixed held part 22 (left end portion) corresponding to the front cover section 5 so as to push the pocket body 3 leftward, based on change in the position of the front cover section 5 and that of the back cover section 7 relative to each other.

If this leftward force acts on the pocket body 3, the insertion hole 23 and the inserted part 25 function as a guide. This moves each pocket body 3 relative to the front cover section 5 along the inserted part 25 to make a transmission from the state shown in FIG. 18 to the state shown in FIG. 19. Then, as shown in FIGS. 9 to 15, the cover body 2 is placed in the closed (folded) state.

Further, with the cover body 2 in the closed state, the rubber 13 is extended from the back cover section 7 to the front cover section 5. This makes the rubber 13 exert contractile force to retain the cover body 2 in the closed state. Then, the file 1 is stored in a bag, for example, and carried.

Additionally, in the foregoing file 1, the storage part 15 of the pocket body 3 is arranged to extend from the front cover section 5 to the back cover section 7. This allows the pocket body 3 with the stored item 4 therein to be bent together with the cover body 2. Thus, the stored item 4 and the pocket body 3 with the stored item 4 therein in the bent state are housed between the front cover section 5 and the back cover section 7. As a result, the file 1 itself can become compact in a plan view compared to the area of the item 4 to be stored in a normal state, making it possible to increase convenience from a viewpoint of a size.

Further, as a result of bending the pocket body 3 in the foregoing manner together with the cover body 2, the stored item 4 in the pocket body 3 receives frictional force larger than the force of friction with the storage part 15 acting when the stored item 4 is in a normally stored state. Thus, even if a user of the file 1 holds the file 1 in the closed state so as to place the opening part 17 of the pocket body 3 at a lower position, the stored item 4 is still unlikely to drop down from the storage part 15. Specifically, even if no consideration is given to the position or direction of the opening part 17 in a state of use, the stored item 4 is still unlikely to drop down unexpectedly from the opening part 17. In this way, convenience from a viewpoint of a state of use can be increased.

In particular, the cover body 2 is openable and closable in the horizontal direction, and the opening part 17 of the pocket body 3 is provided at the end portion of the storage part 15 in the horizontal direction. In this configuration, even if the stored item 4 receives force generated by pointing the opening part 17 downward, for example, and acting to make the stored item 4 drop down from the opening part 17, frictional force is still increased by the bending of the pocket body 3 and the stored item 4 in a direction substantially vertical to the direction of this force. This makes it possible to prevent an unexpected drop of the stored item 4 more reliably.

Also, the spine section 6 having a predetermined width is provided between the front cover section 5 and the back cover section 7, and the front cover section 5 and the back cover section 7 are rotatable relative to each other via the hinge parts 11 at the spine section 6. In this configuration, space responsive to the width of the spine section 6 can be ensured inside the cover body 2 while the file 1 is closed. Thus, bending of the cover body 2 is unlikely to cause a crease, etc. on the stored item 4 in the pocket body 3 in the cover body 2.

Figure 21:
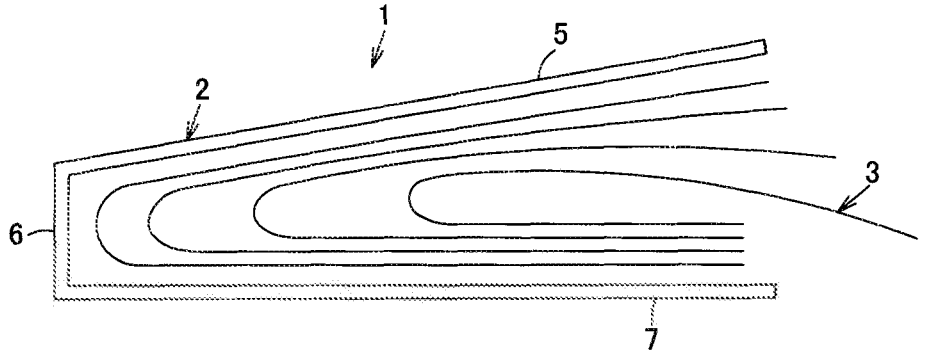
FIG. 21 is a schematic view showing a lower end portion of each pocket body while a file as a reference example is closed.

It is assumed, for example, that multiple stacked pocket bodies 3 are fixed to both the front cover section 5 and the back cover section 7. In this configuration, if the cover body 2 is folded to bend the pocket bodies 3, a difference in a bent form is generated between a pocket body 3 in a bottom layer nearest the cover body 2 and a pocket body 3 in a top layer farthest from the cover body 2. Specifically, after the bending, the pocket body 3 in the bottom layer is located in an outermost periphery, whereas the pocket body 3 in the top layer is located in an innermost periphery of a shorter range than the pocket body 3 in the outermost periphery. Unless the length of the fixed part 16 of each pocket body 3 is increased or reduced, the position of one pocket body 3 adjacent to the cover body 2 and that of a different pocket body 3 adjacent to the one pocket body 3 relative to each other at their fixed parts 16 and their vicinities are to change between the state before the bending and the state after the bending. However, if the one pocket body 3 is fixed so as to be prohibited from moving relative to the different adjacent pocket body 3, the foregoing change in the relative positions is restricted. This causes instability of the position of a lower end portion of each pocket body 3 opposite to the fixed part 16 while the file 1 is closed, as shown in a reference example in FIG. 21. This instability causes the probability of difficulty in retaining the cover body 2 in the closed state and the probability that a part of the pocket body 3 will stick out of the cover body 2.

In this regard, in the file 1, the holding member 21 provided to the front cover section 5 slidably holds the held part 22 of the pocket body 3. Thus, in response to opening and closing of the cover body 2, the insertion hole 23 and the inserted part 25 function as a guide to make each pocket body 3 movable in the horizontal direction along the inserted part 25. Further, displacement of each pocket body 3 in the thickness direction can be restricted by the case unit 24. As a result, change in the position of each pocket body 3 relative to the cover body 2 responsive to opening and closing of the file 1 is allowed only on the part of the front cover section 5. This makes it unlikely that the position of the lower end portion of each pocket body 3 will become unstable even while the file 1 is closed. Thus, the file 1 is easily retained in the closed state by bending the cover body 2 and the pocket body 3.

It is noted that in the foregoing first embodiment, the spine section 6 with the hinge parts 11 is provided between the front cover section 5 and the back cover section 7. However, this is not a limited configuration of the cover body 2. For example, in one configuration, the spine section 6 may be omitted, and the front cover section 5 and the back cover section 7 may be rotatably connected directly. In an alternative configuration, the front cover section 5 and the back cover section 7 may be connected with rings, for example.

In addition, in the foregoing configuration of the cover body 2, the rubber 13 as the retention member is provided at the cover body 2, and the front cover section 5 and the back cover section 7 are each provided with the recess 14 at which the retention member can be engaged. However, this is not a limited configuration. A configuration with the rubber 13 and without the recess 14 is applicable. A configuration without the rubber 13 and without the recess 14, specifically, a configuration without the retention member, is also applicable.

In addition, the configuration with the retention member is not limited to the configuration where the rubber 13 is provided as the retention member. Any retention member capable of retaining the cover body 2 in the closed state is applicable.

The shapes of the cover body 2 and the pocket body 3 are not limited to rectangles but can be designed appropriately.

The cover body 2 and the pocket body 3 are not limited to the configuration of being fixed to each other by welding. The pocket body 3 may be fixed to the cover body 2 by an appropriate method such as sewing or welding.

The holding member 21 and the held part 22 are not limited to the configuration where the plate-like inserted part 25 is inserted in the insertion hole 23. As long as the pocket body 3 can be held slidably relative to the cover body 2, any configuration is applicable. For example, in one configuration, at least one of the front cover section 5 and the back cover section 7 may be provided with a rail-like holding part, and the pocket body 3 may be provided with a held part slidably engaged with the rail-like holding part. In an alternative configuration, an end portion of the pocket body 3 may simply be covered partially by the case unit 24.

The pocket body 3 is not limited to the configuration of being made of a single synthetic resin sheet. As long as the pocket body 3 is configured to include the storage part 15 capable of storing the item 4 to be stored and the fixed part 16 fixed to the cover body 2, the arrangements or methods of forming the storage part 15 and the fixed part 16 can be changed appropriately.

The opening part 17 is not limited to the configuration of being provided at the right end portion of the storage part 15 and substantially parallel to this right end portion. Any configuration allowing the item 4 to be stored to be put into the storage part 15 and allowing the stored item 4 to be taken out from the storage part 15 is applicable to the opening part 17. More specifically, in one configuration, the opening part 17 may be provided at one of the end portions of the storage part 15 in the vertical direction to be substantially vertical to the end portions of the storage part 15 in the horizontal direction, and the item 4 to be stored may be put into the storage part 15 and the stored item 4 may be taken out from the storage part 15 in the vertical direction, for example.

In the foregoing configuration, the fixed part 16 and the held part 22 are provided integrally with the storage part 15, and the fixed part 16 and the held part 22 are integral with each other. However, this is not a limited configuration. In one configuration, the storage part 15, the fixed part 16, and the held part 22 may be provided separately. In an alternative configuration, the fixed part 16 and the held part 22 may be provided separately.

Additionally, the fixed part 16 and the held part 22 are not limited to the configuration of being provided above the storage part 15. The fixed part 16 and the held part 22 are only required to be provided external to the storage part 15 (external to the storage part 15 in the vertical direction or external to the storage part 15 in the horizontal direction).

The cover body 2 and the pocket body 3 are not limited to the configuration where the fixed part 16 is fixed to the back cover section 7, the holding member 21 is provided at the front cover section 5, and the pocket body 3 is held slidably relative to the front cover section 5. As long as the holding member 21 for movably holding the held part 22 of the pocket body 3 is provided to at least one of the front cover section 5 and the back cover section 7, any configuration is applicable.

Figure 20:
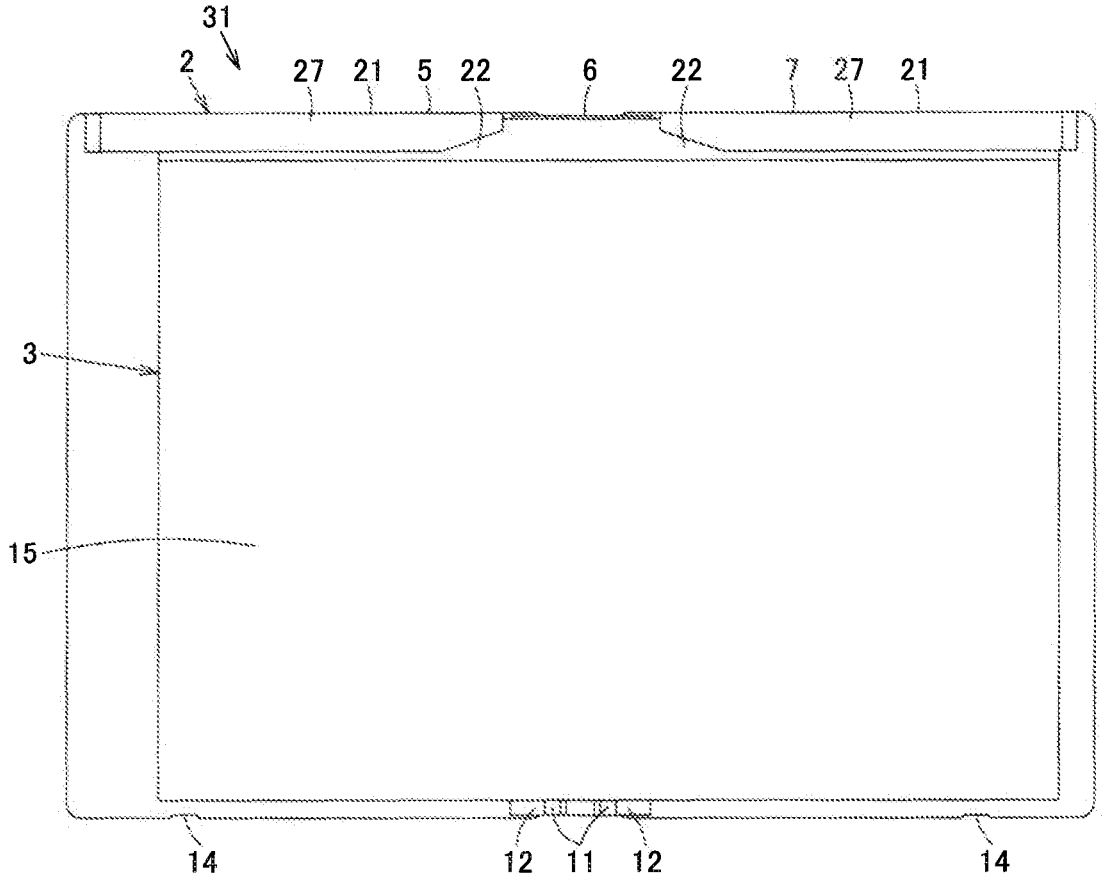
FIG. 20 is a plan view showing the configuration of a file according to a second embodiment of the present invention.

More specifically, like in a file 31 according to a second embodiment shown in FIG. 20, for example, as long as the pocket body 3 is configured to be held movably relative to the cover body 2, the holding members 21 may be provided to both the front cover section 5 and the back cover section 7, and the pocket body 3 may include the held parts 22 corresponding to both the front cover section 5 and the back cover section 7. In the file 31, the pocket body 3 is not fixed to the cover body 2 but is held movably relative to both the front cover section 5 and the back cover section 7.

The present invention is applicable to a file, etc. with a pocket body for storing an item such as a document attached to a cover body.

The invention claimed is:

1. A file comprising:

a cover body comprises a first cover section and a second cover section, and the first cover section and the second cover section are rotatable relative to each other so as to face each other, a pocket body attached to the cover body comprises:

a storage part arranged to extend from the first cover section to the second cover section and allowing storage of an item to be stored, an opening part for putting the item to be stored into the storage part and taking out the stored item from the storage part, and a held part located external to the storage part in a plan view, wherein the cover body includes a holding member provided to at least one of the first cover section and the second cover section and holding the held part movably, the held part includes an insertion hole, the holding member includes an inserted part, and the inserted part is inserted in the insertion hole and allowable to slide in the insertion hole.

2. The file according to claim 1, wherein the holding member is provided to one of the first cover section and the second cover section.

3. The file according to claim 2, wherein the pocket body includes a fixed part fixed to the other cover section.

4. The file according to claim 1, wherein the holding member is provided to each of the first cover section and the second cover section.

5. The file according to claim 1, wherein the length of the insertion hole in one direction is greater than the length of the inserted part in the one direction.

6. The file according to claim 1, wherein the cover body includes a spine section provided between the first cover section and the second cover section to be continuous with the first cover section and the second cover section via a hinge part.

* * * * *